US007119804B2

(12) United States Patent
Sweeney et al.

(10) Patent No.: US 7,119,804 B2
(45) Date of Patent: Oct. 10, 2006

(54) POINT-OF-SALE MARKETING MATERIAL PRESENCE AND VIEWABILITY VERIFICATION SYSTEM AND METHOD

(75) Inventors: William R. Sweeney, Richmond, VA (US); Ulysses Smith, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 354 days.

(21) Appl. No.: 10/348,407

(22) Filed: Jan. 22, 2003

(65) Prior Publication Data

US 2003/0227384 A1 Dec. 11, 2003

Related U.S. Application Data

(60) Provisional application No. 60/384,832, filed on Jun. 4, 2002.

(51) Int. Cl.
*G09G 5/00* (2006.01)

(52) U.S. Cl. ..... 345/214; 345/1.2; 705/27

(58) Field of Classification Search ..... 345/98–99, 345/765, 156, 162, 169, 174–177, 207, 211, 345/214; 705/1, 26, 27, 20–21; 340/5.91–5.92; 235/382–383

See application file for complete search history.

(56) References Cited

U.S. PATENT DOCUMENTS 4,002,886 A 1/1977 Sundelin
4,500,880 A 2/1985 Gomersall et al.
4,978,942 A 12/1990 Bruce
5,295,064 A * 3/1994 Malec et al. ..... 705/1
5,572,653 A 11/1996 DeTemple et al.
5,623,275 A 4/1997 Miller
5,942,986 A 8/1999 Shabot et al.
5,974,393 A 10/1999 McCullough et al.
6,598,791 B1 * 7/2003 Bellis et al. ..... 235/383
6,837,427 B1 * 1/2005 Overhultz et al. ..... 235/382
2002/0082924 A1 * 6/2002 Koether ..... 705/15
2003/0227392 A1 * 12/2003 Ebert et al. ..... 340/825.49
2005/0095573 A1 * 5/2005 Overhultz et al. ..... 434/365

* cited by examiner

*Primary Examiner*—Richard Hjerpe
*Assistant Examiner*—Mansour M. Said
(74) *Attorney, Agent, or Firm*—Buchanan Ingersoll & Rooney PC

(57) ABSTRACT

A system and method is provided for monitoring the viewability of a display, and includes a point-of-sale display, at least one sensor that detects at least one of presence, placement and viewability of a display, a central processing unit that receives an output from the sensor and compares the output with a predetermined value to determine if an abnormal condition affecting viewability of the display exists, and a communication device that communicates an alarm signal produced by the central processing unit under abnormal conditions to a remote recipient or to a storage device.

24 Claims, 2 Drawing Sheets

POINT-OF-SALE MARKETING MATERIAL PRESENCE AND VIEWABILITY VERIFICATION SYSTEM AND METHOD

FIELD OF THE INVENTION

This invention relates to a system and method for verifying the presence, absence or obstruction of a point-of-sale marketing display.

BACKGROUND OF THE INVENTION

Point-of-sale marketing materials are provided to retailers by the manufacturers or distributors of goods and services. The point-of-sale marketing materials can include merchandisers that are not owned by the retailer but are contracted to be placed in various positions within the retail establishment. The merchandisers can include shelves for supporting the manufacturers' products and traditional paper labels or electronic labels that convey pricing or other marketing or promotional information to a prospective customer. A microprocessor can be provided in conjunction with an electronic display to control a display on a display panel of the electronic label. The electronic labels can include capacitor plates that are positioned in close, non-contact relation with a conductor that extends along the edge of the shelf and is connected through a data distribution network to a central data transmission source. The existing systems allow pricing information on the shelves of the merchandiser to be readily modified from a central control station that may be located in an office in the store.

Manufacturers of the goods displayed on the merchandiser often arrange contractually with the retailer to sell some or all of the products under promotions or other sales that may affect the revenue obtained from the sale of the products. The manufacturer may agree with the retailer to accept a reduced amount of revenue per product sold at the promotion or sale price on the assumption that the reduction in revenue per product will be made up by the increased quantity of products sold, or by less tangible benefits such as increased goodwill with the customers. When a manufacturer of a product has many of these remotely controllable or manually modifiable point-of-sale merchandisers distributed at retailers over a wide region, it is often necessary to employ a large sales force to physically travel to the retail establishments for the purpose of changing and/or verifying the point-of-sale displays. In addition to the expense of employing a large sales force, manufacturers of goods that rely on point-of-sale merchandisers often encounter problems in verifying that contractually agreed upon promotions or sales are actually being displayed, and that the displays are positioned as agreed upon for optimum viewability by potential customers. The point-of-sale marketing materials are known on occasion to be removed, destroyed or covered up by competitors, customers and even the retailers despite contractual obligations.

SUMMARY OF THE INVENTION

In view of the above-noted problems with conventional merchandising systems, a system for monitoring viewability of a display is provided that includes a point-of-sale display, at least one sensor that detects at least one of presence, placement and viewability of the display, and a central processing unit that receives an output from the sensor and compares the output with a predetermined value to determine if an abnormal condition affecting viewability of the display exists.

In one embodiment of the invention, the system for monitoring viewability of a display includes a sensor that detects the positioning of the display. In another embodiment of the invention, the system includes a sensor that can detect whether the display is at least partially covered or obstructed in a manner that would affect the viewability of the display.

A method of verifying the viewability of a display according to an embodiment of the invention includes monitoring a sensor positioned on the display to detect at least one of the orientation of the display, the location of the display or the presence of an object blocking viewability of at least part of the display. A signal is output from the sensor to a central processing unit, and the signal from the sensor is compared with a predetermined value to determine whether an abnormal condition affecting viewability of the display exists. An alarm signal can be produced when the signal output from the sensor differs from the predetermined value sufficiently to indicate an abnormal condition affecting viewability of the display.

BRIEF DESCRIPTION OF THE DRAWINGS

The invention, as well as other features and advantages thereof will be best understood by reference to the detailed description of the specific embodiments which follows, when read in conjunction with the accompanying drawings, in which.

DESCRIPTION OF THE PREFERRED EMBODIMENTS

Figure 2:
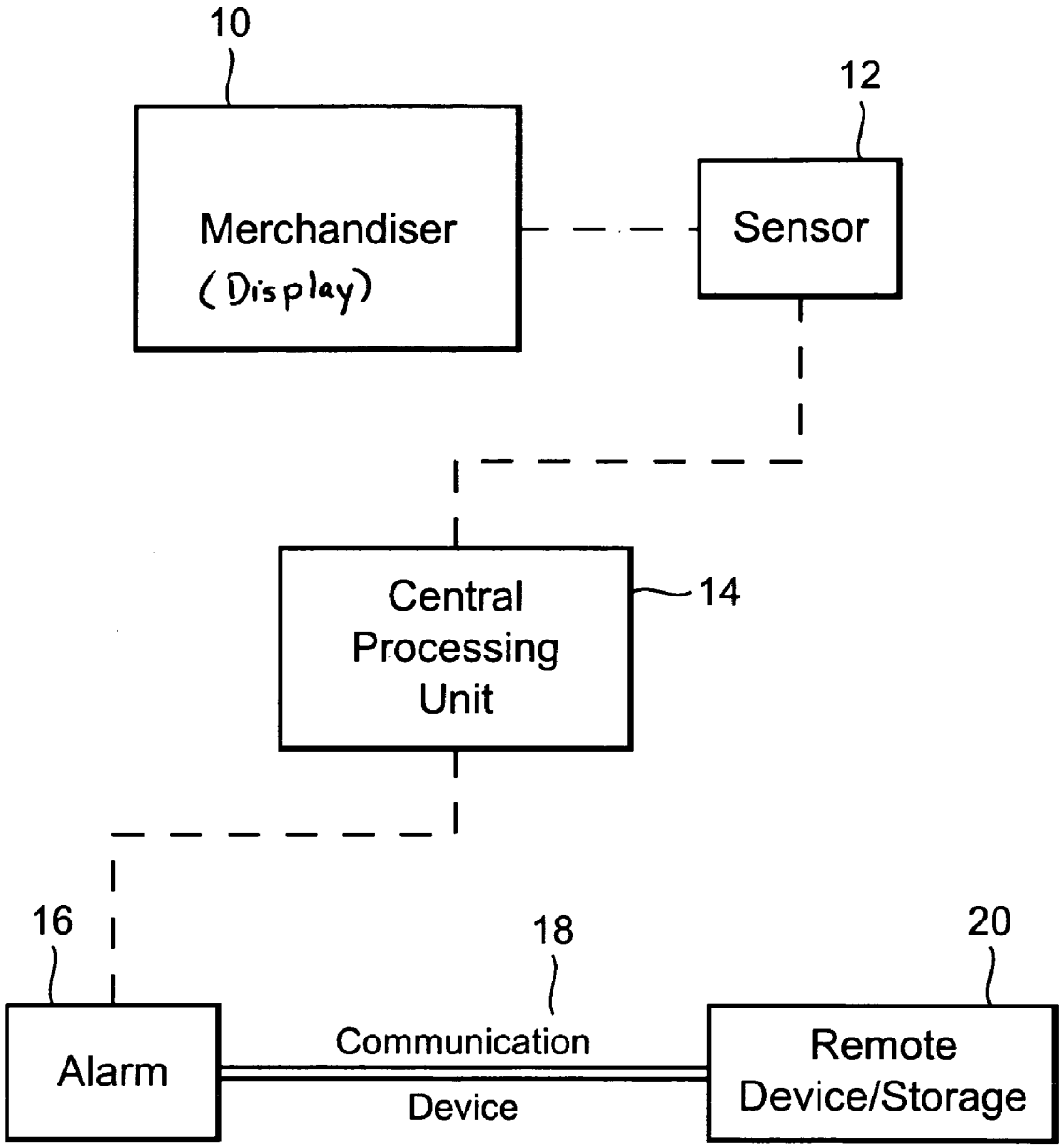
FIG. 2 is a schematic illustration of an embodiment of the invention.

A point-of-sale display in a retail establishment can be in the form of a merchandiser 10 that is not owned by the retailer, but that is provided by the manufacturer of goods under contract to the retailer for the purpose of displaying and selling the manufacturers goods. The merchandiser can be a self-contained unit or simply a portion of the retail establishment's display infrastructure. The merchandiser can also include conventional printed price displays, or preferably electronic sign media such as computer driven flat panel displays or modifiable "electronic paper" having displays made from electric field sensitive materials such as electrophoretic materials, as described in U.S. Pat. No. 6,118,426, which is herein incorporated by reference. The point-of-sale marketing materials provided on the merchandiser may include remotely controllable electronic labels that allow pricing information on shelves of the merchandiser to be readily modified from a central control station that may be located in an office in the store or elsewhere. It would be desirable for the manufacturers of the goods displayed on the merchandiser to be able to verify that the point-of-sale marketing materials are present and positioned for optimum viewability by potential customers, as can be contractually agreed upon with the retailer. A system and method according to an embodiment of the invention monitors the viewability of the point-of-sale display by providing one or more sensors 12 on or in close proximity to the merchandiser 10 that can remotely communicate with other systems to verify the presence, placement and viewability of the point-of-sale marketing materials. As shown schematically in the block diagram of FIG. 2, a central processing unit 14 such as a microprocessor can also be provided to receive output from the sensor 12 and compare the output with a predetermined value to determine if an abnormal condition affecting the viewability of the display exists. A communication device 18 can also be provided in conjunction with the central processing unit 14 such that an alarm signal produced by an alarm portion 16 of the central processing unit 14 upon determining that an abnormal condition affecting the viewability of the display exists, can be communicated by the communication device 18 to a remote recipient or storage device 20 for future reference.

The system and method for monitoring viewability of the display can include at least one sensor 12 that detects the position of the display. The at least one sensor for detecting the position of the display can be a flux gate or other type of electronic compass that detects the actual orientation of the point-of-sale display, thereby providing an indication of whether the display is pointed in the right direction for viewing by a potential customer.

In another embodiment of the invention, the system and method can include at least one sensor that is a Global Positioning System (GPS) or other location sensor, which can provide information regarding the actual location of the display.

In another embodiment of the invention, a sensor can be provided that detects the visibility of the display. The sensor for detecting the visibility of the display can be a light sensitive sensor positioned on the display itself or in close proximity to the display, with the sensor determining whether the display is at least partially covered or obstructed in a manner that might affect its visibility to a potential customer. The light sensitive sensor can include a photoresistive light sensor or a photovoltaic light sensor. If a photovoltaic light sensor is used to provide a signal indicative of the visibility of the display, the photovoltaic light sensor can also produce at least a portion of the power that is actually used by the display.

In another embodiment of the invention, at least one sensor can be provided on the point-of-sale display with the at least one sensor being a contact sensor that detects removal of the display from a surface or placement of an object over a front face of the display. Examples of contact sensors could include electric field sensors, capacitive sensors, dielectric sensors, and acoustical sensors.

In another embodiment of the invention, an infrared, imaging, electric field, microwave or ultrasonic human presence sensor could be provided on the point-of-sale display to provide an indication of the proximity of people who are potentially viewing the display.

Output from any one of the above-mentioned sensors can be provided to a central processing unit such as a microprocessor for comparison with predetermined values in order to determine whether an abnormal condition affecting the viewability of the display exists.

Figure 1:
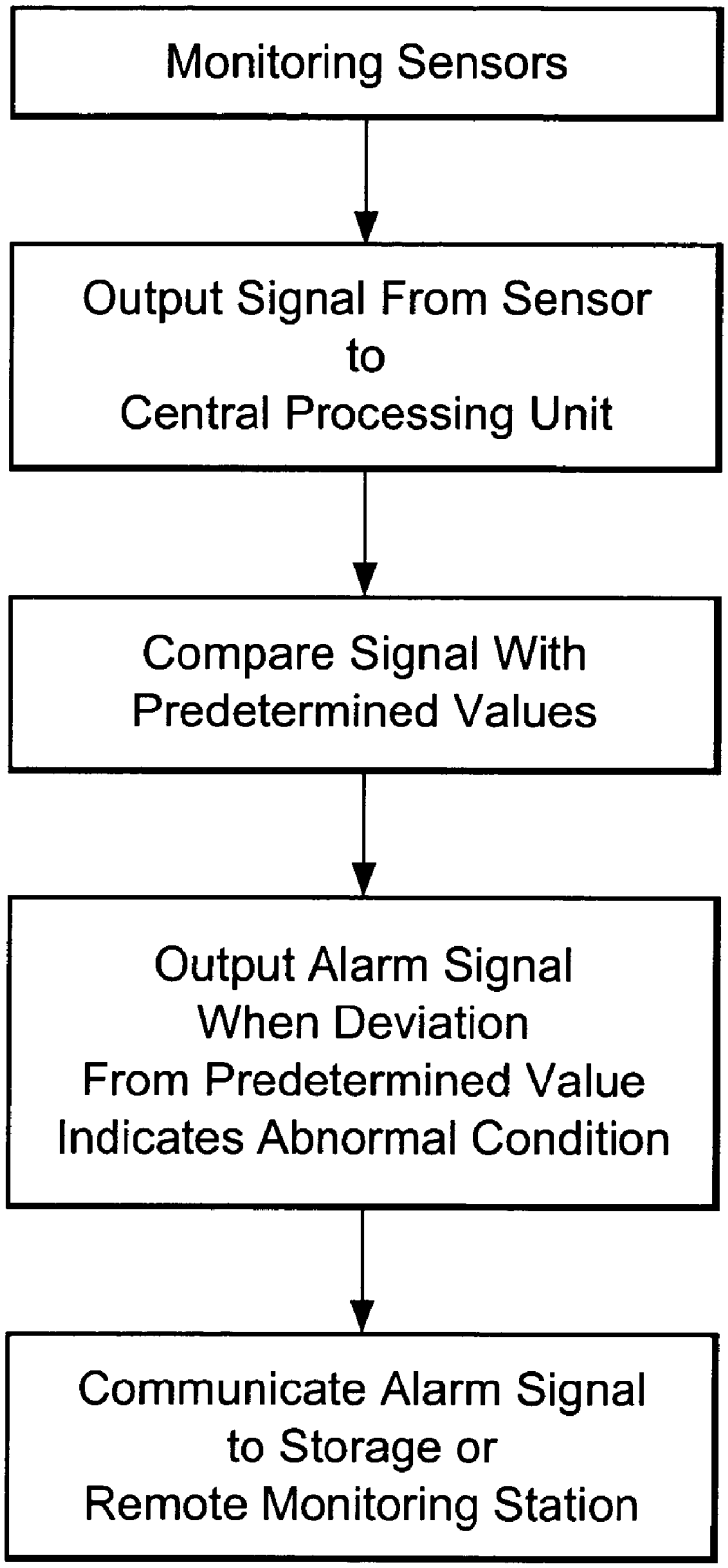
FIG. 1 is a flow chart illustrating the steps involved in an embodiment of the invention.

A method of verifying the viewability of a display according to an embodiment of the invention, as illustrated in the flow chart of FIG. 1, includes monitoring one or more of the above-mentioned sensors positioned on or in close proximity to the display to detect at least one of the orientation of the display, the location of the display or the presence of an object blocking viewability of at least part of the display. A signal from the at least one sensor is output to the central processing unit and compared with a predetermined value to determine whether an abnormal condition affecting viewability of the display exists. An alarm signal can be produced by an alarm portion of the central processing unit when the signal differs from the predetermined value sufficiently to indicate an abnormal condition affecting viewability of the display. The alarm signal can then be communicated using one of a number of different communication devices to a remote location or to a storage device.

The communication device for communicating the alarm signal to a remote location could include at least one of a wired phone, wireless phone, cell phone, PCS, wireless digital data service, two-way data radio, two-way pager or over the Internet.

The system and method according to the invention allows for auditing and verification of the merchandisers that are provided under contract to retail establishments by the manufacturers or distributors of the goods displayed on the merchandiser. A system and method for monitoring the viewability of a display on a merchandiser would allow the manufacturers displaying their products on the merchandiser to dramatically reduce the size of the sales force that is now necessary to physically change and verify the displays on the merchandisers distributed at retailers over remote geographical locations.

The electronic display systems that are provided on the merchandisers for allowing pricing information to be readily modified from a central control station may already include a central processing unit and communication device that can be used by the system and method of the present invention for providing verification of the viewability of the display, thereby minimizing the cost and time involved in implementing the verification system.

The embodiments described above are merely given as examples and it should be understood that the invention is not limited thereto. It is of course possible to embody the invention in specific forms other than those described without departing from the spirit of the invention. Further modification and improvements which retain the basic underlying principles disclosed and claimed herein, are within the spirit and scope of the invention.

What is claimed is:

1. A system for monitoring viewability of a point-of-sale display, comprising:

the point-of-sale display, at least one sensor that detects presence, placement and viewability of the display, and a central processing unit that receives an output from said sensor and compares said output with a predetermined value to determine if an abnormal condition affecting viewability of the display exists.

2. The system according to claim 1, wherein the at least one sensor detects the positioning of the display.

3. The system according to claim 2, wherein the at least one sensor is a flux gate or other type of electronic compass.

4. The system according to claim 1, wherein the at least one sensor is a GPS (Global Positioning System) or other location sensor.

5. The system according to claim 1, wherein the at least one sensor detects the viewability of the display.

6. The system according to claim 5, wherein the at least one sensor is a light sensitive sensor which can detect whether at least a portion of the display is covered.

7. The system according to claim 6, wherein the at least one sensor is a photoresistive light sensor.

8. The system according to claim 6, wherein the at least one sensor is a photovoltaic light sensor.

9. The system according to claim 8, wherein the photovoltaic light sensor produces at least a portion of the power used by the display.

10. The system according to claim 5, wherein the at least one sensor is a contact sensor that detects removal of the display from a surface or placement of an object over a front face of the display.

11. The system according to claim 5, wherein the at least one sensor detects the presence of an object obstructing at least part of a view of the display.

12. The system according to claim 11, wherein the at least one sensor is an electric field sensor.

13. The system according to claim 11, wherein the at least one sensor is a capacitive sensor.

14. The system according to claim 11, wherein the at least one sensor is a dielectric sensor.

15. The system according to claim 11, wherein the at least one sensor is an acoustical sensor.

16. The system according to claim 1, wherein the at least one sensor is attached to a surface of the display.

17. The system according to claim 1, further including a communication device, the central processing unit produces an alarm signal if the output from said sensor is different than said predetermined value, and the alarm signal is communicated by said communication device to a remote recipient or to a storage device.

18. The system according to claim 17, wherein the communication device is at least one of a wired phone, wireless phone, cell phone, PCS, wireless digital data service, two-way data radio, two-way pager, or the Internet.

19. The system according to claim 18, wherein the central processing unit and the communication device are also used in producing the display.

20. A method of verifying the viewability of a point-of-sale display, comprising: monitoring a sensor positioned in the vicinity of the point-of-sale display to detect the orientation of the display, the location of the display and the presence of an object blocking viewability of at least part of the display;

outputting a signal from said sensor to a central processing unit;

comparing the signal from said sensor with a predetermined value to determine whether an abnormal condition affecting viewability of the display exists.

21. The method according to claim 20, further including:

producing an alarm signal when the signal differs from the predetermined value sufficiently to indicate an abnormal condition affecting viewability of the display.

22. The method according to claim 21, further including:

communicating the alarm signal to a remote location.

23. The method according to claim 22, wherein the alarm signal is communicated to a remote location by at least one of a wired phone, wireless phone, cell phone, PCS, wireless digital data service, two-way data radio, two-way pager or the Internet.

24. The method according to claim 21, further including:

storing the alarm signal and logging it for read out at a later time.

* * * * *